US008938181B2

(12) United States Patent
Suzuki

(10) Patent No.: US 8,938,181 B2
(45) Date of Patent: Jan. 20, 2015

(54) IMAGE FORMING APPARATUS HAVING A COLLECTION MEMBER TO COLLECT A VAPORIZED COMPONENT

(75) Inventor: Kazushi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 818 days.

(21) Appl. No.: 13/139,687

(22) PCT Filed: Apr. 9, 2010

(86) PCT No.: PCT/JP2010/002590
§ 371 (c)(1),
(2), (4) Date: Jun. 14, 2011

(87) PCT Pub. No.: WO2010/116753
PCT Pub. Date: Oct. 14, 2010

(65) Prior Publication Data
US 2011/0243598 A1 Oct. 6, 2011

(30) Foreign Application Priority Data
Apr. 10, 2009 (JP) ..... 2009-096143

(51) Int. Cl.
*G03G 21/00* (2006.01)
*G03G 15/20* (2006.01)

(52) U.S. Cl.
CPC .... *G03G 15/2075* (2013.01); *G03G 2215/2093* (2013.01)
USPC ..... 399/98

(58) Field of Classification Search
USPC ..... 399/98
See application file for complete search history.

(56) References Cited

U.S. PATENT DOCUMENTS

| | | | | |
|---|---|---|---|---|
| 6,796,645 | B2 * | 9/2004 | Hayashi et al. | 347/86 |
| 8,532,519 | B2 * | 9/2013 | Hijikata et al. | 399/98 |
| 8,682,206 | B2 * | 3/2014 | Iwasaki | 399/98 |
| 8,725,025 | B2 * | 5/2014 | Murasaki | 399/92 |
| 2012/0141173 | A1 * | 6/2012 | Iwasaki | 399/327 |
| 2014/0086616 | A1 * | 3/2014 | Nojima et al. | 399/98 |
| 2014/0086617 | A1 * | 3/2014 | Nojima | 399/98 |
| 2014/0140720 | A1 * | 5/2014 | Matsumoto et al. | 399/98 |
| 2014/0147162 | A1 * | 5/2014 | Iwasaki | 399/93 |
| 2014/0193171 | A1 * | 7/2014 | Park et al. | 399/98 |

FOREIGN PATENT DOCUMENTS

| | | | |
|---|---|---|---|
| JP | 3-116165 | A | 5/1991 |
| JP | 6-175534 | A | 6/1994 |
| JP | 8-184992 | A | 7/1996 |
| JP | 11-327340 | A | 11/1999 |
| JP | 2000-3070 | A | 1/2000 |
| JP | 2000-61229 | A | 2/2000 |

(Continued)

*Primary Examiner* — David Gray
*Assistant Examiner* — Geoffrey Evans
(74) *Attorney, Agent, or Firm* — Canon USA Inc IP Division

(57) ABSTRACT

There is provided an image forming apparatus capable of minimizing the adhesion of a mold release wax vaporized at the time of heating a toner image to components excluding a fixing device inside the image forming apparatus. The mold release wax vaporized at the time of heating and fixing a toner image to a recording material is collected by a collection member, which is provided between a nip portion forming member and the frame of the fixing device, and kept at a temperature between the melting point and the sublimation point of the mold release wax.

25 Claims, 11 Drawing Sheets

(56) References Cited

FOREIGN PATENT DOCUMENTS

| | | | |
|---|---|---|---|
| JP | 2001-350375 | A | 12/2001 |
| JP | 2002-123097 | A | 4/2002 |
| JP | 2003-91172 | A | 3/2003 |
| JP | 2004-151240 | A | 5/2004 |
| JP | 2005-156997 | A | 6/2005 |
| JP | 2008-185878 | A | 8/2008 |
| JP | 2009-288578 | A | 12/2009 |

* cited by examiner

Fig. 7

| | MATERIAL | MASS m [g] | SPECIFIC HEAT c[J/g・K] | HEAT CAPACITY C[J/K] | SYMBOL |
|---|---|---|---|---|---|
| STAY 108 | IRON | 76.03 | 0.435 | 33.08 | $C_{108}$ |
| BASE PLATE 109 | IRON | 156.45 | 0.435 | 68.05 | $C_{109}$ |
| LOWER FRONT COVER 112 | PBT | 77.70 | 0.985 | 76.53 | $C_{112}$ |
| COLLECTION MEMBER 113 | PBT | 4.37 | 0.985 | 4.30 | $C_{113}$ |
| COLLECTION MEMBER 114 | PBT | 3.22 | 0.985 | 3.17 | $C_{114}$ |
| COLLECTION MEMBER 115 | PBT | 5.17 | 0.985 | 5.09 | $C_{115}$ |

IMAGE FORMING APPARATUS HAVING A COLLECTION MEMBER TO COLLECT A VAPORIZED COMPONENT

TECHNICAL FIELD

The present invention relates to an image forming apparatus such as a copying machine and a printer using an electrophotographic technique.

BACKGROUND ART

An image forming apparatus using an electrophotographic technique is provided with a fixing device for fixing a toner image formed on a recording material on the recording material. The most prevailing method used in the fixing device is a contact heat pressure fixing method in which the toner image is heated and fixed on the recording material while the recording material bearing the toner image is being nipped at a nip portion and conveyed. It is inevitable for the contact heat pressure fixing method to cause a phenomenon of an offset that a part of a toner layer adheres to a fixing roller.

The offset includes several types. A low temperature offset refers to a phenomenon that heat quantity applied to the toner is not enough to sufficiently melt the toner, the toner is not fixed on the recording material, and thereby the toner offsets to the fixing roller. A high temperature offset refers to a phenomenon that heat quantity applied to the toner is excessive to cause the toner to scorch and stick to the fixing roller, and the toner layer is separated.

Other than those above, an electrostatic offset exists. Those offsets cause such problems that surfaces on the front and back sides of the recording material are dirtied from a short-term viewpoint, and an offset toner is accumulated to cause dirty images, cause a failure in the conveyance of the recording material, and shorten the lifetime of the fixing device from a long-term viewpoint.

A toner including a mold release wax has been proposed to prevent the offset phenomenon. The mold release wax is included in the toner, and moved to an interface between a melting toner and the fixing roller in heating and fixing the toner. That prevents the melting toner layer from being separated toward the fixing roller side, and an offset resistance is improved.

The mold release wax included in the toner is liquefied in heating and fixing the toner and a part thereof is vaporized. "A component vaporized from the wax," which is cooled immediately after vaporization, is solidified again to be moved along with wind flowing in the image forming apparatus. A solidified wax component is liquefied again at a place high in temperature in the apparatus, and adheres thereto.

A place being in contact with the recording material tends to be high in temperature in the image forming apparatus. In other words, the wax component tends to adhere to a conveyance guide and a conveyance roller for the recording material. The adhesion of the wax component to the conveyance guide and the conveyance roller for the recording material hinders the recording material from being conveyed or decreases a friction coefficient of the conveyance roller.

The temperature setting of a heater in the fixing device tends to become higher to meet the demand for an increase in an image forming processing speed. Along with that, the amount of components vaporized from the mold release wax also increases, which may frequently cause the phenomenon that the aforementioned mold release wax component adheres to various places in the image forming apparatus. For this reason, it is important to develop a technique to collect components vaporized from the wax to prevent the components from adhering to various places in the image forming apparatus.

Japanese Patent Application Laid-Open No. 2004-151240 discusses a technique for an absorption sheet for collecting oil (wax), which adheres to the inner face of frame of the fixing device and then drips down.

Japanese Patent Application Laid-Open No. 2008-185878 discusses a technique in which short fibers (aramid fibers) absorbing vaporized wax are planted in the inner face of housing of the fixing device to hold the wax.

CITATION LIST

Patent Literature

PTL 1: Japanese Patent Application Laid-Open No. 2004-151240

PTL 2: Japanese Patent Application Laid-Open No. 2008-185878

SUMMARY OF INVENTION

Technical Problem

It has been known that, in a low heat-capacity fixing device including an endless belt, a ceramic heater in contact with the inner face of the endless belt, and a pressure roller for forming a fixing nip portion with the ceramic heater through the endless belt, "a component vaporized from the wax" hardly adhere to the inner face of frame of the fixing device.

A study on that reason has revealed that the low heat-capacity fixing device is different in a change in temperature from a heat-roller fixing device using a halogen lamp discussed in Japanese Patent Application Laid-Open Nos. 2004-151240 and 2008-185878.

For the heat-roller fixing device using a halogen lamp, a halogen heater is heated in a standby period, during which a print signal is waited, to keep the fixing device warm in order to shorten a time period from the input of a print signal to the completion of print (First Print Out Time: FPOT). Therefore, the inner face of frame of the fixing device reaches a high temperature in the standby period, and the inner face of the frame probably reaches a temperature at which a vaporized component easily adheres at the time of the first printing.

On the other hand, the low heat-capacity fixing device described above has the advantage that the FPOT can be shortened without heating the ceramic heater (or in a small heat quantity) in a standby period during which a print signal is waited. However, the ceramic heater is not heated in the standby period (or, a heat quantity is small), so that the temperature of inner face of frame of the fixing device in the standby period is appreciably lower than a temperature at which "a component vaporized from the wax" adheres. For this reason, it has been found that the temperature of inner face of the frame at the time of the first printing is low enough not to cause the vaporized component to adhere.

A high temperature setting of a heater in the fixing device to meet the demand for an increase in an image forming processing speed causes the wax to tend to vaporize at the first sheet of a continuous printing. For this reason, a technique is demanded, in which the vaporized component is collected in the fixing device as early as possible even in the image forming apparatus including the low heat-capacity fixing device.

Solution to Problem

According to an aspect of the present invention, an image forming apparatus includes: an image forming unit configured to form a toner image on a recording material using toner including a mold release wax; a fixing unit configured to heat and fix the toner image on the recording material to the recording material at a nip portion, the fixing unit including nip portion forming members for forming the nip portion and frames for housing the nip portion forming members; and a collection member configured to collect "a component vaporized from the mold release wax" generated by heat at the nip portion, the collection member being provided between the nip portion forming members and the frames and kept at a temperature between the melting point and the sublimation point of the mold release wax.

According to another aspect of the present invention, an image forming apparatus includes: an image forming unit configured to form a toner image on a recording material using toner including a mold release wax; a fixing unit configured to heat and fix the toner image on the recording material to the recording material at a nip portion, the fixing unit including nip portion forming members for forming the nip portion and frames for housing the nip portion forming members; and a collection member configured to collect "a component vaporized from the mold release wax" generated by heat at the nip portion, the collection member being provided between the nip portion forming members and the frames.

Advantageous Effects of Invention

According to the present invention, a component vaporized from the mold release wax is liquefied again and absorbed by a collection member kept at a temperature between the melting point and the sublimation point of the mold release wax, thereby minimizing the adhesion of the mold release wax to a paper guide or the conveyance roller.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

FIG. 7 is a table describing heat capacity of the collection members 113 to 115, a stay 108, a base plate 109, and a lower front cover 112 according to the first exemplary embodiment of the present invention.

DESCRIPTION OF EMBODIMENTS

Example 1

Various exemplary embodiments, features, and aspects of the invention will be described in detail below with reference to the drawings.

A full-color laser beam printer being an image forming apparatus equipped with a fixing device is described below. Although a full-color laser beam printer equipped with a plurality of photosensitive drums is taken as an example of an image forming apparatus, the present invention is also applicable to a fixing device mounted on a monochrome copying machine or a printer, which include a single photosensitive drum. The image forming apparatus including the fixing device according to the present invention is not limited to the full-color laser beam printer.

Figure 1:
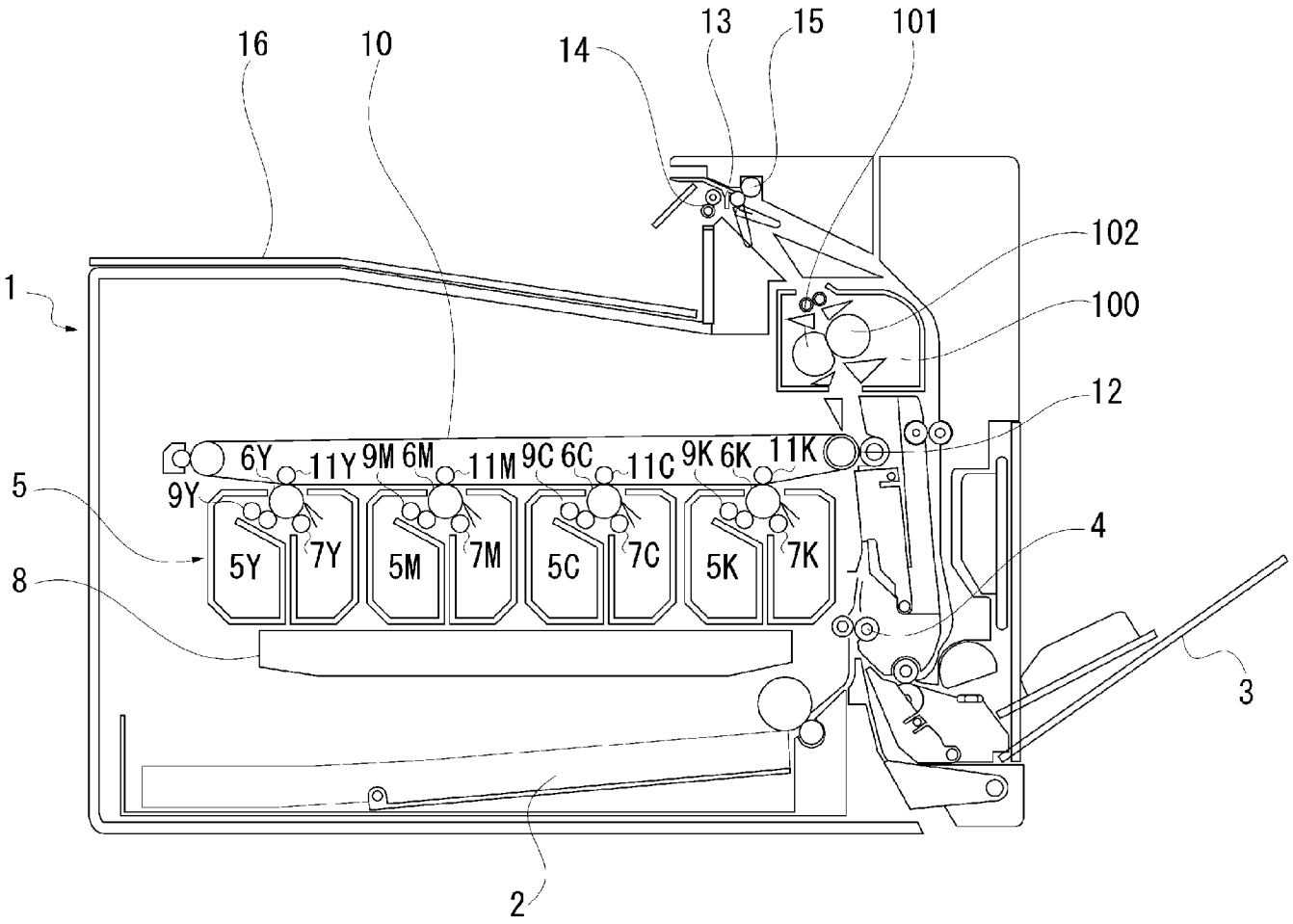
FIG. 1 is a cross section view illustrating a main body of an image forming apparatus including a fixing device.

FIG. 1 is a vertical sectional view illustrating an overall configuration of a full-color laser beam printer 1 (hereinafter referred to as a printer 1).

A cassette 2 is housed in the lower portion of the printer 1, and can be drawn therefrom. A manual feed unit 3 is arranged on the right of the printer 1. Recording materials are stacked on and housed in the cassette 2 and the manual feed unit 3. The recording materials are separated sheet by sheet and conveyed to a registration roller pair 4. The printer 1 includes an image forming unit 5 in which image forming stations 5Y, 5M, 5C, and 5K corresponding to yellow, magenta, cyan, and black respectively are arranged side by side.

The image forming unit 5 includes photosensitive drums 6Y, 6M, 6C, and 6K (hereinafter referred to as a photosensitive drum 6) being image bearing members, charging devices 7Y, 7M, 7C, and 7K for uniformly charging the surface of the photo-sensitive drum 6, a scanner unit 8 in which the photosensitive drum 6 is irradiated with a laser beam based on image information to form an electrostatic latent image on the photosensitive drum 6, development devices 9Y, 9M, 9C, and 9K for causing a toner to adhere to the electrostatic latent image and to develop it as a toner image, and primary transfer units 11Y, 11M, 11C, and 11K for transferring the toner image on the photo-sensitive drum 6 to an electrostatic transfer belt 10 (hereinafter referred to as a primary transfer unit 11).

The toner image transferred to the transfer belt 10 at the primary transfer unit 11 is transferred to the recording material at a secondary transfer unit 12. Thereafter, the recording material passes through a fixing device 100 for fixing the transferred image when passing a nip formed of a heating unit 101 and a pressure roller 102 pressed against the heating unit 101. A conveyance path is switched by a double-faced flapper to convey the recording material to either a discharge roller pair 14 or a switch back roller pair 15.

The recording material conveyed to the switch back roller pair 15 is reversed and conveyed by the switch back roller pair 15, passes through again the registration roller pair 4, the secondary transfer unit 12, and the fixing device 100, and then conveyed to the discharge roller pair 14. The recording material passes through the discharge roller pair 14, and then is discharged to a recording material stacking portion 16.

Figure 2:
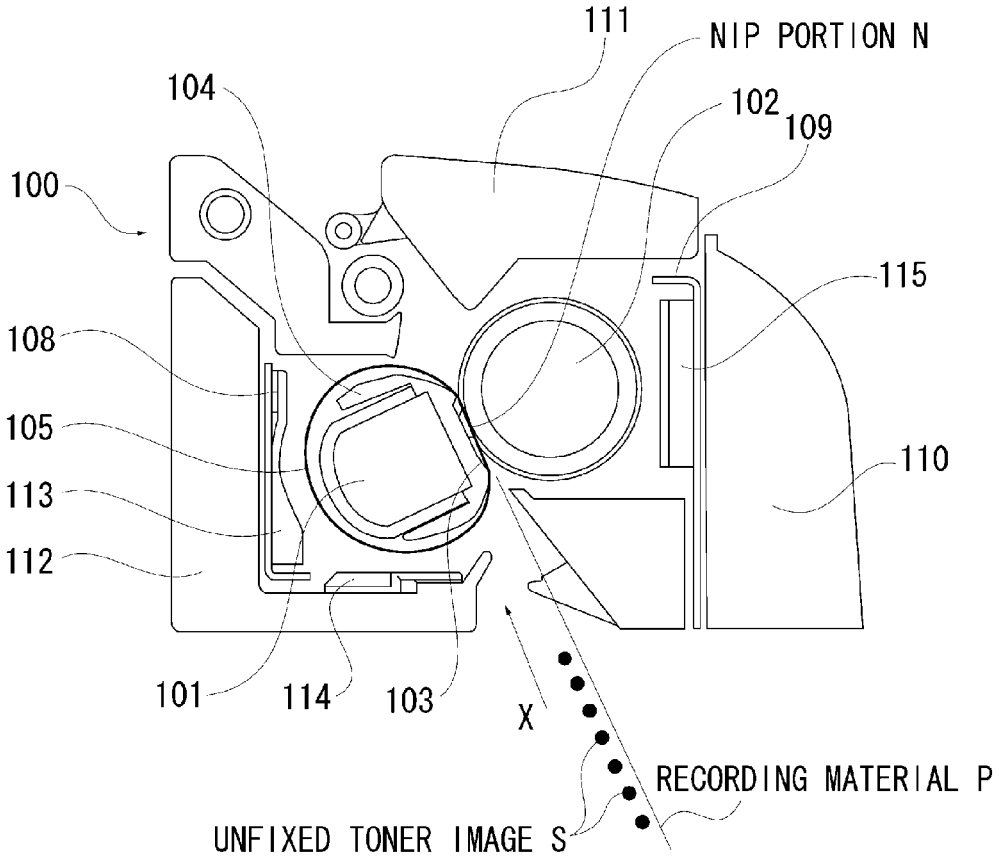
FIG. 2 is a cross section view of the fixing device according to a first exemplary embodiment of the present invention.
Figure 3:
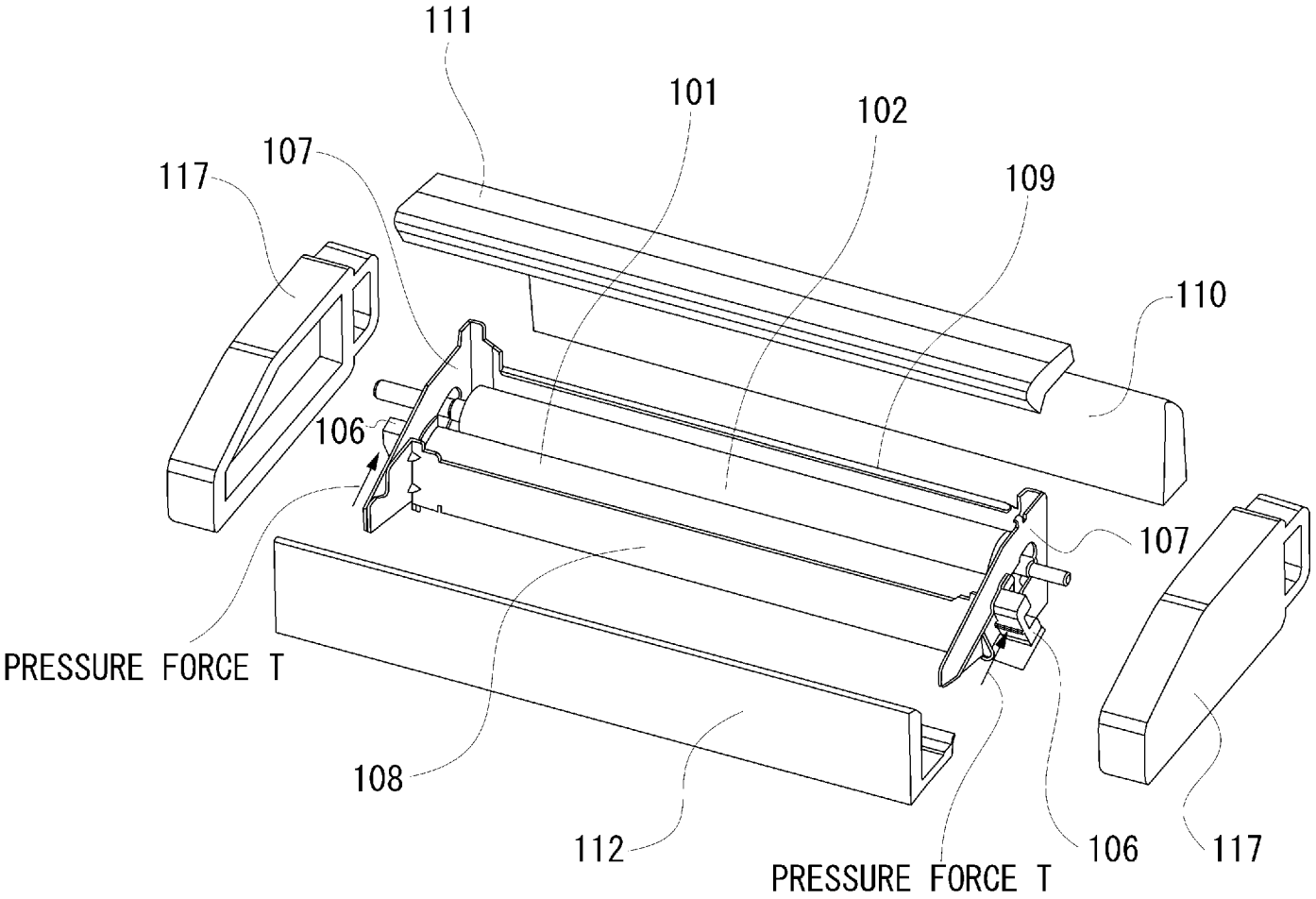
FIG. 3 is a perspective view of the fixing device according to the first exemplary embodiment of the present invention.

A detailed configuration of the fixing device 100 provided in the printer 1 is described below with reference to FIGS. 2 and 3. FIG. 2 is a vertical section view of the fixing device 100. FIG. 3 is a perspective view inside the fixing device 100.

In the fixing device 100, the heating unit 101 has a heater (ceramic heater) 103. The heater 103 is supported by a heater holder 104 being a supporting member. The heater holder 104 is formed of a heat resistant resin such as a liquid crystal polymer with high heat resistance and slidability. The heater holder 104 is covered with a fixing sleeve (endless belt) 105.

The fixing sleeve 105 and the pressure roller 102 have substantially the same perimeter. Both ends of the fixing sleeve 105 are rotatably held by the periphery of a pair of sleeve flanges 106. Both ends of the heater holder 104 are also held by the sleeve flanges 106. A pair of side plates 107 holds the pair of sleeve flanges 106. The pressure roller 102 is pressed against the fixing sleeve 105 with a predetermined pressing force T to oppose the heater 103 that is supported by the heater holder 104.

This forms a nip portion N between the fixing sleeve 105 and the pressure roller 102. Thus, the members for forming the nip portion include an endless belt, a heater that is into contact with the inner face of the endless belt, and a pressure roller forming the nip portion with the heater via the endless belt. The nip portion is a region where the recording material bearing the toner image formed using a toner containing a mold release wax is heated while being nipped and conveyed.

The heating unit 101 and the pressure roller 102 are surrounded by the pair of the side plates 107, a stay 108, a base plate 109, all of which are sheet metal members. The three members are frames for forming the fixing device 100, ensure the rigidity of the fixing device 100, and house the members for forming the nip portion.

The pair of the side plates 107, the stay 108, and the base plate 109 are surrounded by a back cover 110, an upper cover 111, a lower front cover 112, and a left and right cover 117. A user is not allowed access to the pair of the side plates 107, the stay 108, and the base plate 109. The lower portion of the lower front cover 112 directly faces the heating unit 101 to also function as a frame for forming the fixing device 100.

A collection member 113 is provided for the face of the stay 108 opposing the fixing sleeve 105. A collection member 114 is provided for the face of the lower front cover 112 opposing the fixing sleeve 105. A collection member 115 is provided for the face of the base plate 109 opposing the pressure roller 102. The user is not allowed access to all the collection members 113 to 115.

A gap of 3 mm is formed between the collection members 113 and 114 and the fixing sleeve 105. A gap of 1.5 mm is formed between the collection member 115 and the pressure roller 102. The collection member, the detail of which is described later, is kept at a temperature between the melting point and the sublimation point of the mold release wax, and collects the mold release wax heated and generated at the nip portion. The collection member is provided between the members for forming the nip portion and the frames for housing the members for forming the nip portion.

The detailed configuration of the collection members 113, 114, and 115 is described below with reference to FIGS. 4 to 6.

The collection members 113, 114, and 115, each being made of 1 mm thick Poly-butyleneterephtalate (PBT) containing glass, have a load deflection temperature of 207 degrees (Celcius) (1.82 Mpa, and the test method of ISO 075-1 and 2). The collection members are tabular as illustrated in the figure. The wall thickness thereof is thin, which most probably causes a short in injection molding. The increase of injection pressure, temperature of a die, or temperature of resin to deal with the short increases a warp of a component, which may bring the collection members into contact with the fixing sleeve 105 or the pressure roller 102.

The collection members 113, 114, and 115 are configured such that not using a long member but short members are arranged side by side and used in pairs. (This shall not apply in the case where a precut product, an extruded sheet material or a blanked sheet material is used.)

Figure 4:
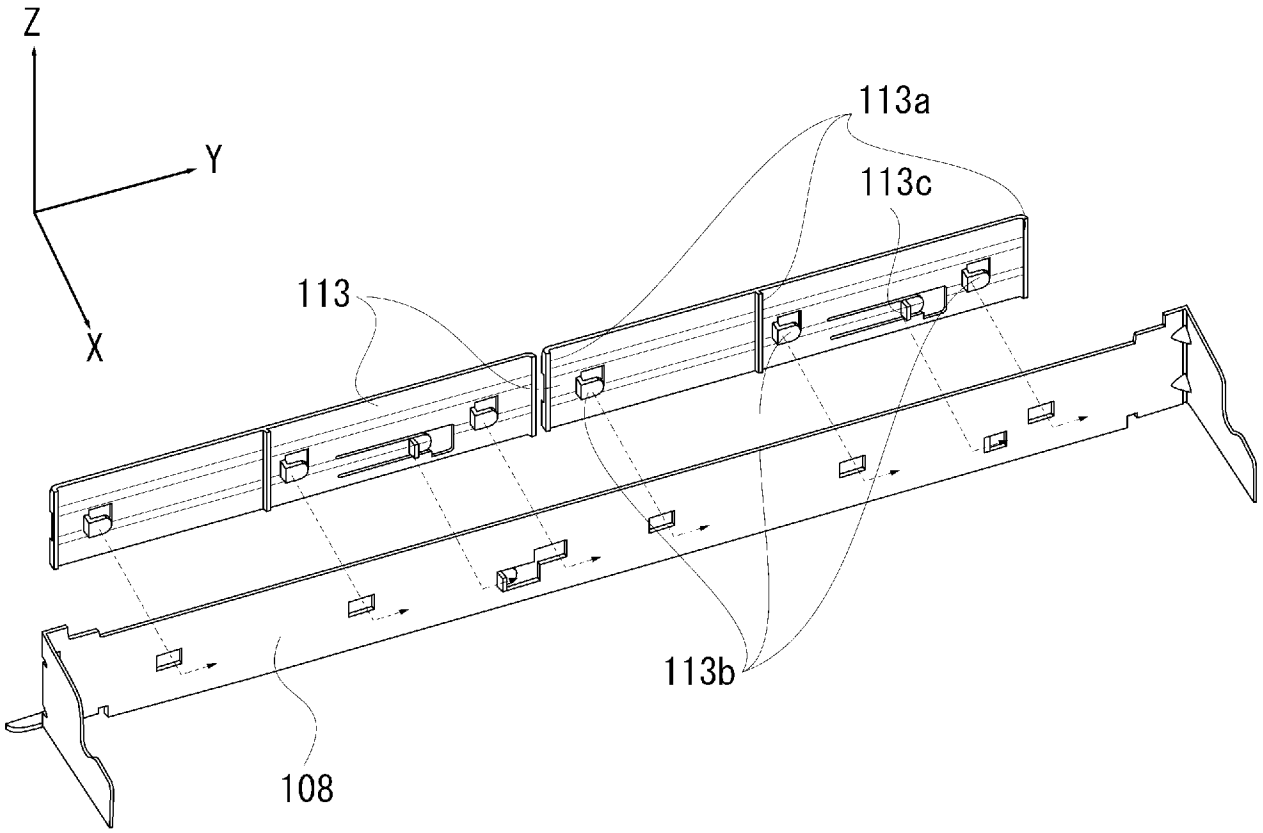
FIG. 4 is a detailed perspective view of a collection member 113 according to the first exemplary embodiment of the present invention.

As illustrated in FIG. 4, the collection member 113 is provided with ribs 113*a* at both ends and the center thereof and claws 113*b* in the vicinity of the rib 113*a*. The claw 113*b* and a stopper 113*c* are hooked through square holes made on the stay 108 to fix the collection member 113 to the stay 108. The claw 113*b* regulates the X and Z directions and the stopper 113*c* regulates the Y direction.

Only inner faces of the rib 113*a* and the claw 113*b* are brought into contact with the stay 108. Other portions are not brought into contact therewith. A gap is provided between the collection member 113 and the stay 108 to which the collection member 113 is attached, and insulated by air space. An area is decreased where the collection member 113 is brought into contact with the stay 108 and a gap is provided between the portion where the rib 113*a* and the claw 113*b* are not located and the stay 108 to prevent heat from being transferred from the collection member 113 to the stay 108.

Figure 5:
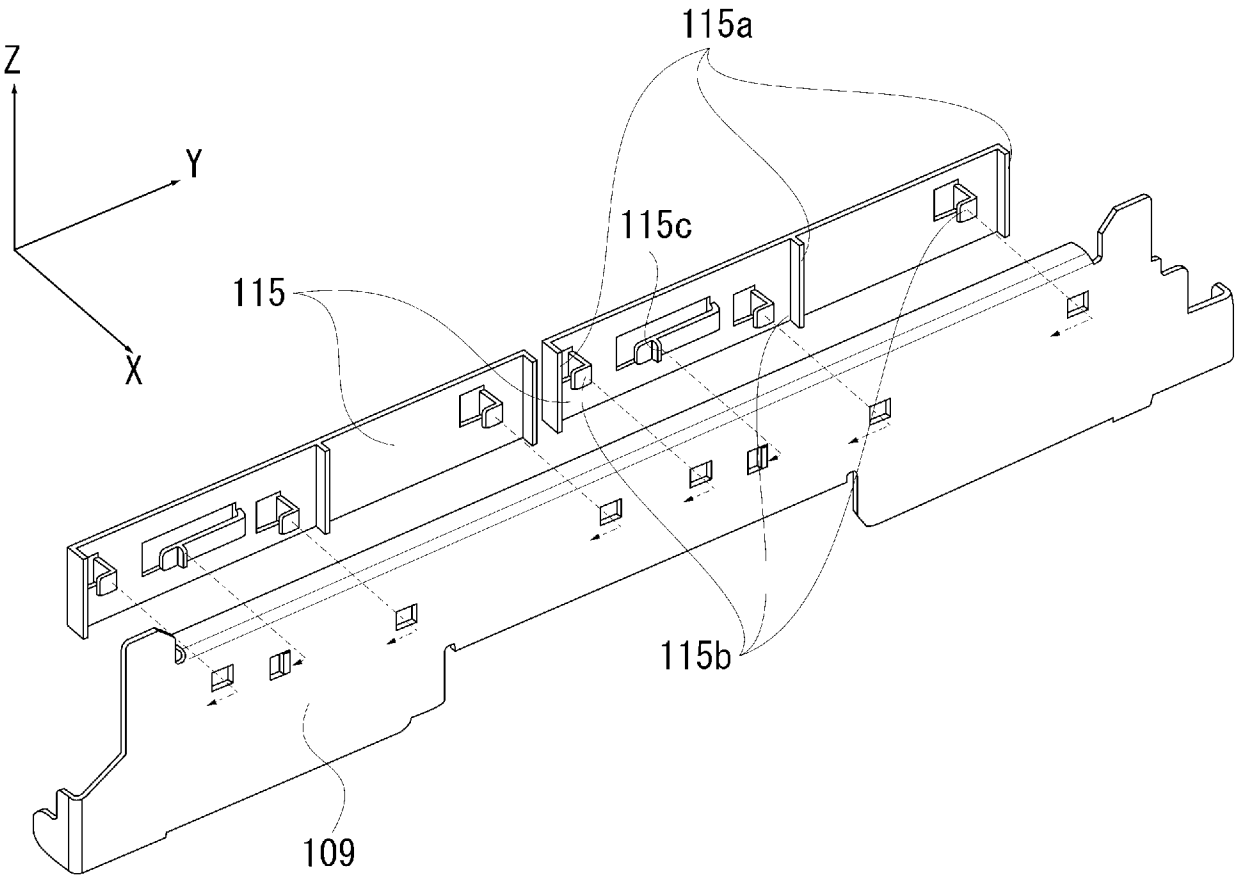
FIG. 5 is a detailed perspective view of a collection member 115 according to the first exemplary embodiment of the present invention.

A method of attaching the collection member 115 to the base plate 109 is quite similar to that of attaching the collection member 113 to the stay 108 (refer to FIG. 5). For this reason, the description thereof is omitted here.

Figure 6:
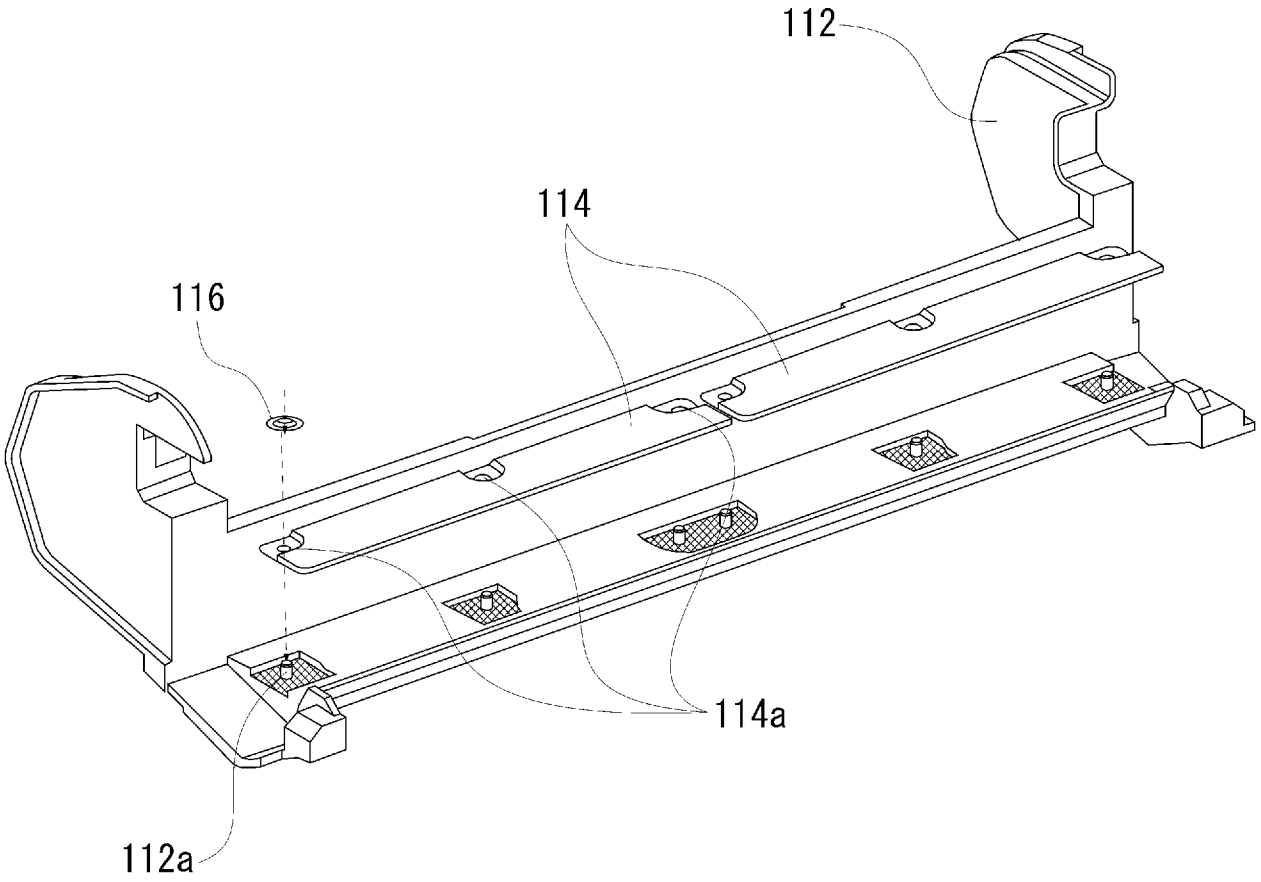
FIG. 6 is a detailed perspective view of a collection member 114 according to the first exemplary embodiment of the present invention.

As illustrated in FIG. 6, the collection member 114 is fixed by a snap fit 116 in such a manner that a boss 112*a* provided on the lower front cover 112 is inserted into a hole 114*a* made in the collection member 114 (at both ends of the lower front cover 112 and the three positions at the center thereof). The collection member 114 is brought into contact with the lower front cover 112 only at a counterbored face (meshed area in FIG. 6) around the boss 112*a*. A gap is provided in other areas therebetween.

Similar to the collection members 113 and 115, an area is decreased where the collection member 114 is brought into contact with the lower front cover 112, and a gap is provided in other areas to prevent heat from being transferred from the collection member 114 to the lower front cover 112. In other words, the gap between the collection member and the member to which the collection member is attached is insulated by air space.

The heat capacity C of each component is illustrated in FIG. 7. The heat capacity C is represented by the following equation:

$$C=mc$$

where C is heat capacity [J/KL], m is mass [g], and c is specific heat [J/g*K]. As illustrated in FIG. 7, the collection member 113 is significantly smaller in heat capacity than the stay 108 to which the collection member 113 is attached. The collection member 114 is significantly smaller in heat capacity than the lower front cover 112 to which the collection member 114 is attached. The collection member 115 is significantly smaller in heat capacity than the base plate 109 to which the collection member 115 is attached.

Heat capacity in the table shows the heat capacity of one collection member out of a plurality of the respective collection members attached to the members to which the respective collection members 13 to 15 are attached (for example, the heat capacity of one out of two collection members 113 attached to the stay 108).

It is desirable that the heat capacity of the collection members 113 to 115 provided in the place near the fixing sleeve 105 is as small as possible so that a temperature quickly rises to a melting point or above after the start of print. In other words, it is desirable that, if the heat capacity of a collection member is taken as C1 and the heat capacity of a member to which the collection member is attached is taken as C2, a relationship of C1<C2 is satisfied.

A detailed configuration of the fixing sleeve 105 and the pressure roller 102 is described below with reference to FIGS. 8A and 8B.

Figure 8A:
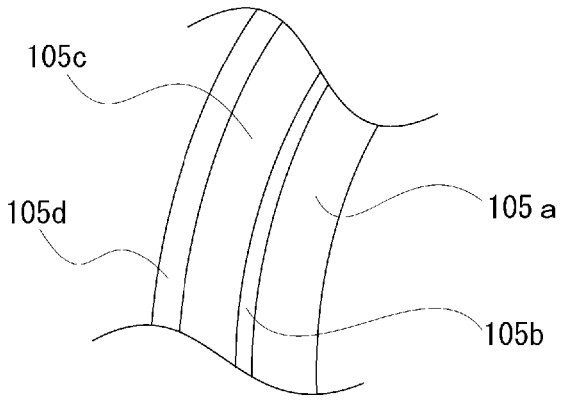
FIG. 8A illustrates a detailed configuration of a sleeve 105 according to the first exemplary embodiment of the present invention.

As illustrated in FIG. 8A, the fixing sleeve 105 includes an endless substrate 105*a*, a primer layer 105*b* provided on the periphery of the substrate 105*a*, an elastic layer 105*c* provided on the periphery of the primer layer 105*b*, and a mold release layer 105*d* provided on the periphery of the elastic layer 105*c*. The substrate 105*a* is a metallic base layer such as stainless steel (SUS) excellent in heat transfer and 30 mm in thickness to have enough strength so that the fixing device can withstand thermal stress and mechanical stress, and ensure a long lifetime.

The primer layer 105*b* is formed in such a manner that an about 5 mm thick conductive primer into which a suitable amount of conductive particles such as carbon is dispersed is coated on the substrate 105*a*. The elasticity of the elastic layer 105*c* can wrap the toner image borne by the recording material P, and can realize uniform heating and pressure fixing.

The mold release layer 105*d* is formed in such a manner that an about 20 mm thick PFA resin (tetrafluoroethylene-perfluoroalkyl vinyl ether copolymer) being fluororesin, which is excellent in mold release characteristic and high in heat resistance, is coated to prevent toner or paper dust from adhering and ensure a separating performance of the recording material P from the fixing sleeve 105.

Figure 8B:
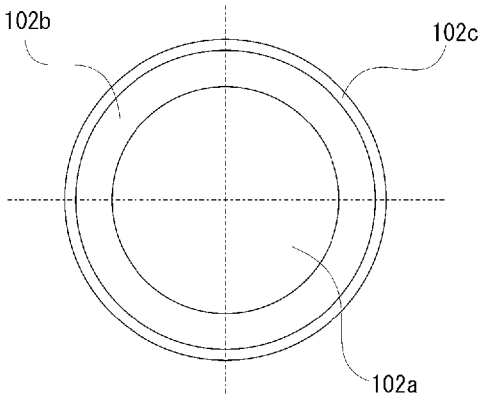
FIG. 8B illustrates a detailed configuration of a pressure roller 102 according to the first exemplary embodiment of the present invention.

As illustrated in FIG. 8B, the pressure roller 102 includes a metallic (aluminum or iron) cored bar 102*a*, an elastic layer 102*b* of silicone rubber formed outside the cored bar 102*a*, and a mold release layer 102*c* covering the surface of the elastic layer 102*b*. Both ends of the cored bar 102*a* are rotatably supported with bearing in the pair of side plates 107.

The elastic layer 102*b* uses a solid rubber layer of silicone rubber or a sponge rubber layer formed by foaming silicone rubber to provide the layer with insulation effectiveness. The mold release layer 102*c* is formed in such a manner that a tube is covered with fluororesin such as PFA resin.

A heater drive control circuit as a control circuit includes a power supply apparatus and a CPU for controlling the power supply apparatus. In the heater drive control circuit, the CPU inputs a print signal to the power supply apparatus to turn on and off the apparatus, energizing the heating resistor of the heater 103. The energization of the heating resistor causes the temperature of the heater 103 to rapidly rise.

The temperature of the heater 103 is controlled to a predetermined target set temperature based on a temperature detected by a thermister (not shown) as a temperature detection unit provided on the back (on the surface opposite to the nip portion N) of the heater 103, and the heater 103 heats the fixing sleeve 105 to the predetermined target set temperature. The set temperature in the present exemplary embodiment is 180 degrees (Celcius).

In this condition, the recording material P bearing an unfixed toner image S is introduced from the recording material conveyance direction to the nip portion N, and the recording material P is nipped and conveyed by the nip portion N (refer to FIG. 2).

In the present exemplary embodiment, the leading edge of the recording material P reaches the nip portion N 7.3 seconds after the print signal is input. The heat of the heater 103 is transferred to the recording material P through the fixing sleeve 105 at this conveyance process. The unfixed toner image S is fixed onto the face of the recording material P by the heat of the heater 103 and nip pressure. The recording material P left the nip portion N is curvature-separated from the surface of the fixing sleeve 105 and conveyed to the discharge roller pair 14 or the switch back roller pair 15.

The melting point and the sublimation point of the mold release wax included in the toner are described below. The peak temperature at the maximum heat-absorbing peak of the mold release wax is measured by a differential scanning calorimetry (DSC) apparatus Q1000 (produced by TA instruments Inc.) in conformity with American Society for Testing and Materials (ASTM) D3418-82. The temperature of the apparatus detection unit is corrected using the melting point of indium and zinc. The heat quantity is corrected using heat of melting of indium.

Specifically, an about 10 mg toner is precisely weighed and put into an aluminum pan. An empty aluminum pan is used as a reference. A measurement is conducted at a temperature rise rate of 1 degrees (Celcius)/min within a measurement temperature range of 30 degrees (Celcius) to 200 degrees (Celcius). In measurement, a temperature is risen to 200 degrees (Celcius), then lowered to 30 degrees (Celcius), and thereafter risen again. The maximum heat-absorbing peak of a DSC curve within a temperature range of 30 degrees (Celcius) to 200 degrees (Celcius) in the second temperature rise process is taken as the maximum heat-absorbing peak of a heat-absorbing curve in the DSC measurement of the mold release wax, and this temperature is defined as a melting point (Tm).

Figure 9A:
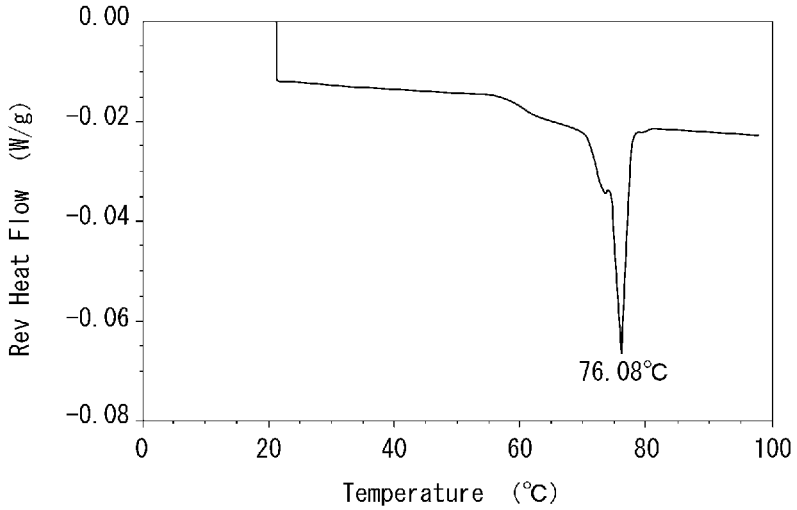
FIG. 9A is a graph illustrating a melting point of a mold release wax according to the first exemplary embodiment of the present invention.
Figure 9B:
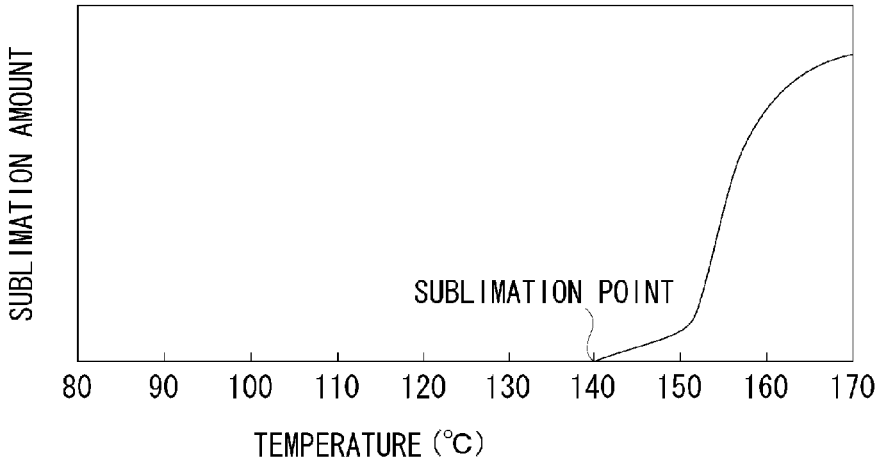
FIG. 9B is a graph illustrating a sublimation point of a mold release wax according to the first exemplary embodiment of the present invention.

The sublimation point of the mold release wax is measured using a particle counter "Handheld 3016" (produced by Lighthouse Inc.). Specifically, the temperature of the 10 mg precisely-weighed "toner including the mold release wax" is increased and measured in a space sealed by a box with dimensions of 30 cm*30 cm*30 cm. In this measurement, a temperature at which the particle counter starts counting is defined as a sublimation point (Ts). In other words, a temperature at which the particle counter detects "a component first vaporized from the mold release wax" is defined as a sublimation point of the mold release wax. The melting point (Tm) of the mold release wax used in the present exemplary embodiment is 76.08 degrees (Celcius) (refer to FIG. 9A) and the sublimation point (Ts) thereof is 140 degrees (Celcius) (refer to FIG. 9B).

Figure 10A:
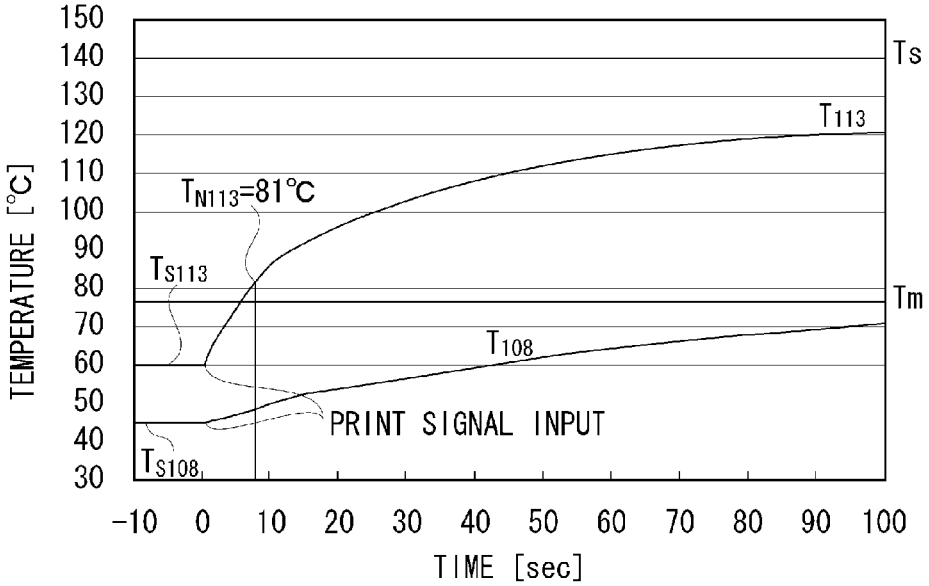
FIG. 10A illustrates temperature profiles of the collection member 113 and the stay 108 according to the first exemplary embodiment of the present invention.

The temperature profile of the collection member 113 and the stay 108 is illustrated in FIG. 10A. The temperature profile of the collection member 113 is represented by T113 and that of the stay 108 is represented by T108.

Measurement conditions for T113 and T108

Temperature: 23 degrees (Celcius)

Humidity: 50%

Recording material: 75 gsm and LTR size

Sheet-passing condition: the image forming apparatus is left untouched for 24 hours under the above environment, then the image forming apparatus is left untouched for 60 minutes after the power supply of the main body is turned on, and one side of each sheet is continuously passed.

The collection member 113 is heated by a radiation heat radiated from the fixing sleeve 105. The heater 103 is controlled at a temperature of 120 degrees (Celcius) in the standby period during which the print signal is waited and the peripheral components are also warmed, so that the temperature of the collection member 113 does not reach a temperature of the environment under which the printer is placed. For this reason, as illustrated in FIG. 10A, the temperature Ts113 of the collection member 113 measured before the print signal is input varies between 59 degrees (Celcius) and 60 degrees (Celcius).

When the print signal is input and the temperature of the heater 103 starts rising rapidly, the temperature of the collection member 113 also starts rising rapidly. The temperature TN113 of the collection member 113 at the time of the leading edge of the recording material P reaching the nip portion N rises to 81 degrees (Celcius) and reaches the melting point Tm of the mold release wax. After that, the temperature of the collection member 113 rises, but the temperature curve becomes gradually gentle and eventually becomes flat below the sublimation point Ts.

The temperature rise rate and the attainable temperature of the collection member 113 can be easily changed by adjusting a heat capacity C113, specifically by changing the amount of the gap between the collection member 113 and the fixing sleeve 105 and the material and volume of the collection member 113. The temperature of the collection member 113 can be set between the melting point Tm and the sublimation point of various kinds of a mold release wax before the leading edge of the recording material P reaches the nip portion N.

Thus, in the fixing device according to the present exemplary embodiment, the temperature of the collection member 113 reaches the melting point or above of the mold release wax before the leading edge of the recording material P reaches the nip portion N. The collection member 113 is kept within a temperature range from the melting point to the sublimation point the mold release wax in printing (during a time interval when a fixing process is performed).

Since the stay 108 is farther from the fixing sleeve 105 than the collection member 113 and the heat capacity C108 of the stay 108 is about eight times the heat capacity C113 of the collection member 113, the temperature Ts108 measured before the print signal is input is about 45 degrees (Celcius), lower than that of the collection member 113. The rise time of the temperature after the input of the print signal is very slow, and the temperature does not reach the melting point Tm in 100 seconds. That is to say, the heat of the collection member 113 is hardly transferred to the stay 108, and the heat capacity C108 is greater, so that the temperature of the stay 108 moderately increases.

While the temperature of the collection member 113 reaches the melting point or above of the mold release wax before the leading edge of the recording material P reaches the nip portion N, the temperature of the stay 108 does not reach the melting point of the mold release wax.

Figure 10B:
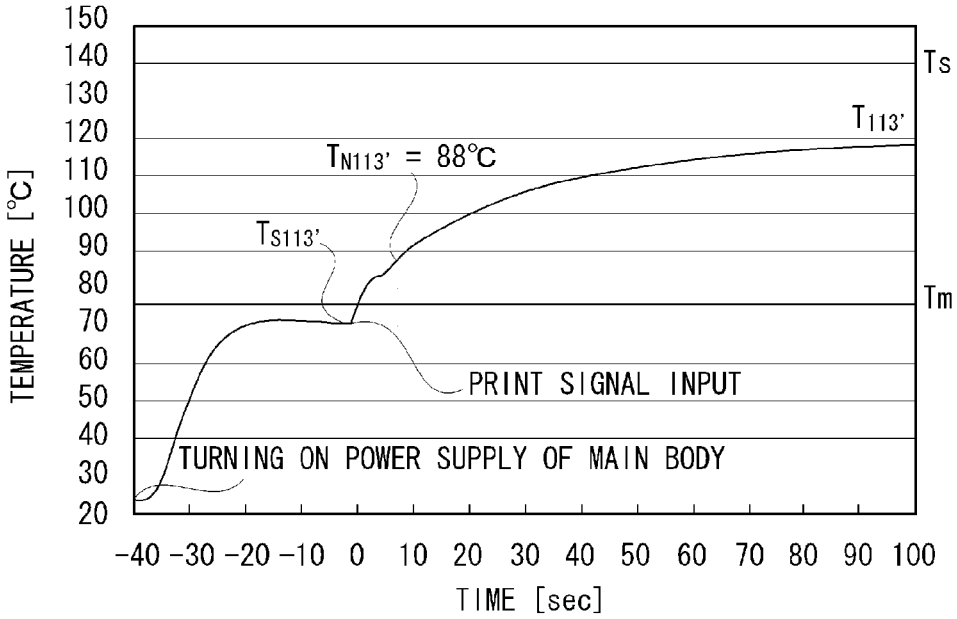
FIG. 10B illustrate temperature profiles of the collection member 113 according to the first exemplary embodiment of the present invention.

The temperature profile T113' of the collection member 113 acquired when sheet is continuously passed through immediately after the power supply of the main body is turned on is illustrated in FIG. 10B.

Measurement condition for T113'

Temperature: 23 degrees (Celcius)

Humidity: 50%

Recording material: 75 gsm and LTR size

Sheet-passing condition: the image forming apparatus is left untouched for 24 hours under the above environment and then one side of each sheet is continuously passed immediately after the power supply of the main body is turned on.

After the power supply of the main body is turned on, the heater 103 is quickly heated to a temperature at which the fixing process can be performed, and the temperature of the collection member 113 starts rising quickly. After that, the temperature Ts113' of the collection member 113 measured before the print signal is input varies between 71 degrees (Celcius) and 73 degrees (Celcius). The temperature TN113' of the collection member 113 at the time of the leading edge of the recording material P reaching the nip portion N has risen to 88 degrees (Celcius) and has reached the melting point Tm of the mold release wax.

Thereafter, the temperature TN113' is similar to the temperature T113 in profile. The similar heating process is performed not only after the power supply of the main body is turned on, but also after a jamming handling is restored or an energy saving mode is restored. For this reason, the temperature of the collection member reaches 76.08 degrees (Celcius) or above at the time of the leading edge of the recording material P reaching the nip portion N independently of the following states of the printer 1: at the time of standby; after the power supply of the main body is turned on; after a jamming handling is restored; and an energy saving mode is restored.

Figure 11:
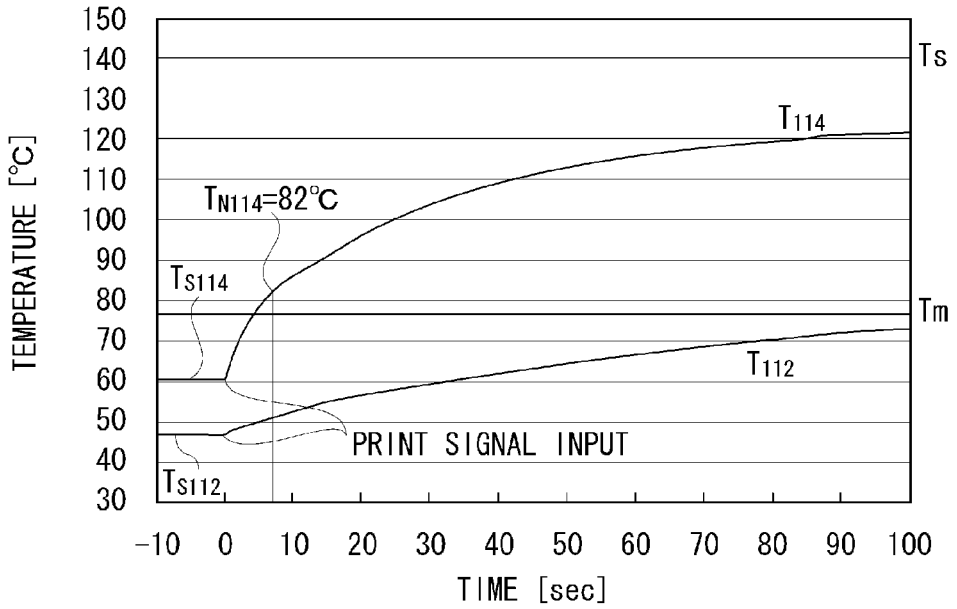
FIG. 11 illustrates a temperature profile of the collection member 114 and the lower front cover 112 according to the first exemplary embodiment of the present invention.

The temperature profile of the collection member 114 and the lower front cover 112 is illustrated in FIG. 11. The temperature profile of the collection member 114 is represented by T114 and that of the lower front cover 112 is represented by T112. Measurement conditions are quite similar to ones for T113 and T108.

An arrangement is made so that the temperature of the collection member 114 reaches 76.08 degrees (Celcius) or above (TN114=82 degrees (Celcius)) before the leading edge of the recording material P reaches the nip portion N, which provides a temperature profile T114 which is substantially similar to that of the collection member 113. For that reason, the description thereof is omitted. The temperature profile of the lower front cover 112 is similar to that of the stay 108, from which it is clear that heat is hardly transferred from the collection member 114 to the lower front cover 112.

The heat capacity C114 of the collection member 114 is about 1/24 of the heat capacity C112 of the lower front cover 112. If heat is easily transferred from the collection member 114 to the lower front cover 112 or the lower front cover 112 is provided with the function of the collection member 114, the temperature of the lower front cover 112 rises, the user may touch a portion of which temperature is high at the time of jamming handling or replacing the fixing device.

Figure 12:
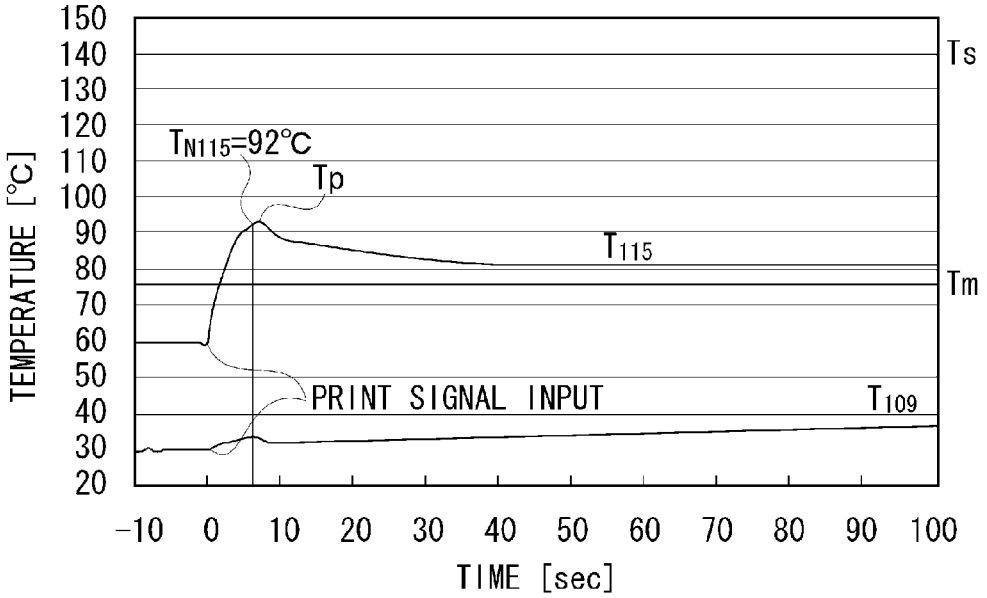
FIG. 12 illustrates temperature profiles of the collection member 115 and the base plate 109 according to the first exemplary embodiment of the present invention.

The temperature profile T115 of the collection member 115 and the temperature profile T109 of the base plate 109 are illustrated in FIG. 12. Measurement conditions are quite similar to ones for T113 and T108. While the collection members 113 and 114 are heated by a radiation heat radiated from the fixing sleeve 105, the collection member 115 is heated by a radiation heat radiated from the pressure roller 102.

When the print signal is input and the heater is energized to rapidly increase the temperature, the temperature of the collection member 115 also starts rising rapidly. The temperature TN115 of the collection member 115 at the time of the leading edge of the recording material P reaching the nip portion N has risen to 92 degrees (Celcius). When the recording material P is nipped by the nip portion N, however, the recording material P deprives the pressure roller 102 of heat to lower the temperature of the pressure roller 102. At the same time, the temperature of the collection member 115 lowers from the peak Tp just after TN115. While sheet is being passed through, the fixing sleeve 105 is continuously supplied with heat from the heater 103.

On the other hand, the pressure roller 102 does not include a heat supply source except the heater 103. For this reason, the pressure roller 102 is deprived of heat by the recording material P to lower the temperature of the pressure roller 102. However, the heat quantity of which the recording material P deprives the pressure roller 102 is always constant, so that the temperature of the pressure roller 102 does not continue to fall and is almost constant while sheet is being passed through. The temperature of the collection member 115 lowers from the peal Tp, but varies within the range from 80 degrees (Celcius) to 83 degrees (Celcius).

The heat capacity C115 of the collection member 115 is about 1/13 of the heat capacity C109 of the base plate 109. For this reason, the temperature rise rate of the base plate 109 after the print signal is input is very slow. If at least one of a plurality of collection members inside the fixing device 100 reaches the melting point Tm at the time of the leading edge of the recording material P reaching the nip portion N, it is possible to collect the mold release wax.

The wax component heated and vaporized by a fixing unit is instantly cooled and solidified again. As described above, the melting point Tm of the mold release wax included in the toner used for the present exemplary embodiment is 76.08 degrees (Celcius) and the sublimation point Ts thereof is 140 degrees (Celcius) degrees (Celcius), so that the mold release wax is in a liquid phase within a range from 76.08 degrees (Celcius) to 140 degrees (Celcius).

When the mold release wax is in a liquid phase, the collection members 113 to 115 are wetted and an intermolecular force acts between the mold release wax and the collection members 113 to 115 to allow the adsorption of the mold release wax. In other words, the temperature of the collection members 113 to 115 is increased to the melting point Tm or higher and the wax component vaporized and solidified again is rendered to a liquid phase again, thereby allowing the collection members 113 to 115 to collect the mold release wax.

If the temperature of the collection members 113 to 115 is the melting point Tm or below, the mold release wax is in a solid phase, so that the collection members 113 to 115 are not wetted. An intermolecular force acting between the mold release wax and the collection members 113 to 115 is too small to cause the collection members 113 to 115 to absorb the mold release wax.

If the temperature of the collection members 113 to 115 exceeds the sublimation point Ts, the collected mold release wax is sublimated again from the collection members 113 to 115. For the above reasons, the temperature of the collection members 113 to 115 is kept within a range from 76.08 degrees (Celcius) to 140 degrees (Celcius) to enable the collection members 113 to 115 to liquefy again and absorb the mold release wax, which is heated and sublimated by the nip portion and then solidified.

It is desirable to quickly increase the temperature of the collection members 113 to 115 after the print signal is input to cause the temperature of the collection members 113 to 115 to reach the melting point Tm of the mold release wax before the leading edge of the recording material P reaches the nip portion N in order to stably collect the mold release wax also at the time of printing a small number of pages, for example, at the time of printing a single page intermittently.

The temperature of the collection members 113 to 115 is caused to reach the melting point Tm of the mold release wax before the leading edge of the recording material P reaches the nip portion N to allow the collection members 113 to 115 to stably absorb the mold release wax in any sheet-passing mode.

If a plurality kinds of mold release waxes are used, it is desirable to vary the temperature of the collection members 113 to 115 in the temperature range between the melting point of a mold release wax that is the highest in those of the mold release waxes and the sublimation point of a mold release wax that is the lowest in those of the mold release waxes.

Effects of the present exemplary embodiment are described below. The collection members 113 to 115 provided between the heating unit 101 and the stay 108, between the heating unit 101 and the lower front cover 112, and between the pressure roller 102 and the base plate 109 are caused to actively absorb the mold release wax to allow the minimization of a conveyance failure due to the adhesion of the mold release wax to a recording material guide or a conveyance roller. The temperature of the collection members 113 to 115 is caused to reach the melting point Tm of the mold release wax before the leading edge of the recording material P reaches the nip portion N to allow the collection of the mold release wax irrespective of the number of pages to be printed in one job.

The heat capacities of the collection members 113, 114, and 115 are made as small as possible as compared with those of the say 108, the lower front cover 112, and the base plate 109 respectively to shorten a time during which the temperature of the collection members 113, 114, and 115 rises to the melting point of the mold release wax, thereby allowing shortening of a time from the input of the print signal to the start of printing.

Gaps are provided between the collection member 113 and the stay 108, between the collection member 114 and the lower front cover 112, and between the collection member 115 and the base plate 109 to minimize heat transfer, decreasing the amount of heat absorption of the collection members 113 and 114 to a constant level. This stabilizes the temperature of the fixing sleeve 105 while the sheet is being passed through to enable ensuring an energy saving and a stable fixing function.

This also prevents an increase in the temperature of the lower front cover 112, which the user may touch. The gap is used as a heat insulation member to allow the realization of an inexpensive collection configuration for the mold release wax.

Example 2

A fixing device according to a second exemplary embodiment is described below. A characteristic point inside the fixing device, which is different from that of the first exemplary embodiment, is described.

Figure 13:
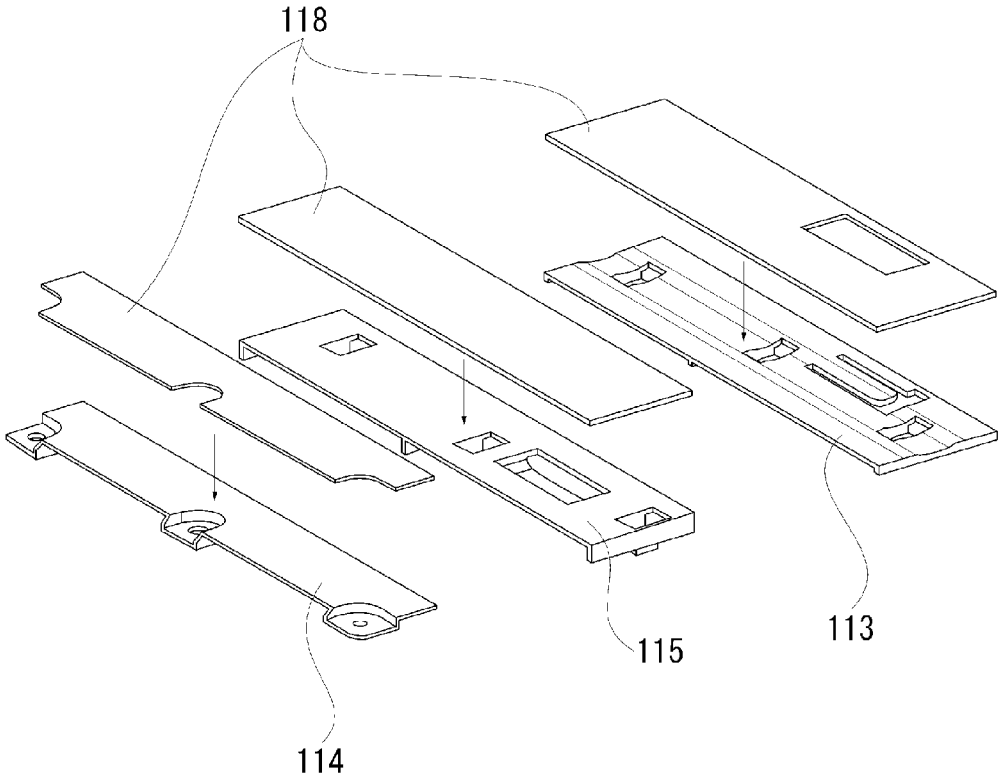
FIG. 13 is a detailed perspective view of collection members 113 to 115 according to a second exemplary embodiment of the present invention.

In the fixing device 100 according to the second exemplary embodiment, a heat-resistant unwoven fabric 118 that can impregnate the mold release wax is attached on the surface of the collection members 113, 114, and 115 (refer to FIG. 13). The heat-resistant unwoven fabric 118 is an aggregate of fibers each having an average diameter of several tens of micrometers. The external surface area thereof is much larger than that of an ordinary resin component. The heat-resistant unwoven fabric 118 that can impregnate the mold release wax is attached on the surface of the collection members 113, 114, and 115 to increase the external surface area of the collection members, thereby enabling the amount of collection of the mold release wax.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-096143 filed Apr. 10, 2009, which is hereby incorporated by reference herein in its entirety.

REFERENCE SIGNS LIST

1 printer
5 image forming unit
100 fixing device
101 heating unit
102 pressure roller
108 stay
109 base plate
112 lower front cover
113 to 115 collection members
118 heat-resistant unwoven fabric

The invention claimed is:

1. An image forming apparatus comprising:

an image forming unit configured to form a toner image on a recording material using toner including a mold release wax;

a fixing unit configured to heat and fix the toner image on the recording material to the recording material at a nip portion, wherein the fixing unit includes nip portion forming members for forming the nip portion and frames for housing the nip portion forming members; and a collection member configured to collect a component vaporized from the mold release wax generated by heat at the nip portion, wherein the collection member is provided between the nip portion forming members and the frames and kept at a temperature between a melting point and a sublimation point of the mold release wax.

2. The image forming apparatus according to claim 1, wherein a temperature of the collection member is lower than the melting point in a standby period in which the image forming apparatus waits for a print signal, and the temperature of the collection member rises to a temperature between the melting point and the sublimation point after the print signal is input to the apparatus.

3. The image forming apparatus according to claim 2, wherein the temperature of the collection member reaches the melting point or above of the mold release wax before a leading edge of the recording material reaches the nip portion.

4. The image forming apparatus according to claim 2, wherein, if a heat capacity of the collection member is C1 and a heat capacity of a member, which forms the frame and to which the collection member is attached, is C2, a relationship of C1<C2 is satisfied.

5. The image forming apparatus according to claim 1, wherein a material of the collection member is resin.

6. The image forming apparatus according to claim 1, wherein the collection member has a heat-resistant unwoven fabric that can impregnate the vaporized component on the surface thereof.

7. The image forming apparatus according to claim 1, wherein a gap between the collection member and a member to which the collection member is attached is insulated by an air space.

8. The image forming apparatus according to claim 1, wherein the nip portion forming members include an endless belt, a heater that is in contact with an inner face of the endless belt, and a pressure roller for forming the nip portion with the heater via the endless belt.

9. An image forming apparatus comprising:

an image forming unit configured to form a toner image on a recording material using toner including a mold release wax;

a fixing unit configured to heat and fix the toner image on the recording material to the recording material at a nip portion, the fixing unit including nip portion forming members for forming the nip portion and frames for housing the nip portion forming members; and a tabular collection member configured to collect a component vaporized from the mold release wax generated by heat at the nip portion, wherein the collection member is provided between the nip portion forming members and the frames;

wherein the tabular collection member is maintained at a predetermined temperature.

10. The image forming apparatus according to claim 9, wherein, if a heat capacity of the collection member is C1 and a heat capacity of a member, which forms the frame and to which the collection member is attached, is C2, a relationship of C1<C2 is satisfied.

11. The image forming apparatus according to claim 9, wherein a material of the collection member is resin.

12. The image forming apparatus according to claim 9, wherein the collection member has a heat-resistant unwoven fabric that can impregnate the vaporized component on the surface thereof.

13. The image forming apparatus according to claim 9, wherein a gap between the collection member and a member to which the collection member is attached is insulated by an air space.

14. The image forming apparatus according to claim 9, wherein the nip portion forming members include an endless belt, a heater that is in contact with an inner face of the endless belt, and a pressure roller for forming the nip portion with the heater via the endless belt.

15. An image forming apparatus comprising:

an image forming unit configured to form a toner image on a recording material using toner including a mold release wax;

a fixing unit configured to heat and fix the toner image on the recording material to the recording material at a nip portion, wherein the fixing unit includes nip portion forming members for forming the nip portion and frames for housing the nip portion forming members; and a collection member configured to collect a component vaporized from the mold release wax generated by heat at the nip portion, wherein the collection member is provided between the nip portion forming members and the frames, and wherein the collection member maintains a temperature at which the component vaporized from the mold release wax is in a liquid phase by radiation heat radiated from the nip portion forming members.

16. The image forming apparatus according to claim 15, wherein a temperature of the collection member is lower than a melting point of the mold release wax in a standby period in which the image forming apparatus waits for a print signal, and the temperature of the collection member rises to the temperature at which the component vaporized from the mold release wax is in a liquid phase after the print signal is input to the apparatus.

17. The image forming apparatus according to claim 16, wherein the temperature of the collection member reaches the temperature at which the component vaporized from the mold release wax is in a liquid phase before a leading edge of the recording material reaches the nip portion.

18. The image forming apparatus according to claim 16, wherein, if a heat capacity of the collection member is C1and a heat capacity of a member, which forms the frame and to which the collection member is attached, is C2, a relationship of C1<C2 is satisfied.

19. The image forming apparatus according to claim 15, wherein a material of the collection member is resin.

20. The image forming apparatus according to claim 19, wherein a material of the collection member is polybutylene-terephtalate.

21. The image forming apparatus according to claim 15, wherein the collection member has a tabular shape, and the collection member is provided such that a plane of the collection member is opposed to the nip portion forming members.

22. The image forming apparatus according to claim 21, wherein the collection member has a tabular shaped member and a heat-resistant unwoven fabric formed on a surface of the tabular shaped member that can impregnate the vaporized component on the surface of the fabric.

23. The image forming apparatus according to claim 15, wherein a gap between the collection member and a member to which the collection member is attached is insulated by an air space.

24. The image forming apparatus according to claim 15, wherein the nip portion forming members include an endless belt.

25. The image forming apparatus according to claim 15, wherein the nip portion forming members include an endless belt, a heater that is in contact with an inner face of the endless belt, and a pressure roller for forming the nip portion with the heater via the endless belt.

* * * * *